US006675619B2

(12) United States Patent
Clark

(10) Patent No.: US 6,675,619 B2
(45) Date of Patent: Jan. 13, 2004

(54) SHEET BENDING BRAKE

(75) Inventor: Michael C. Clark, Columbiaville, MI (US)

(73) Assignee: Tapco International Corporation, Wixom, MI (US)

( * ) Notice: Subject to any disclaimer, the term of this patent is extended or adjusted under 35 U.S.C. 154(b) by 54 days.

(21) Appl. No.: 10/068,408

(22) Filed: Feb. 6, 2002

(65) Prior Publication Data

US 2002/0124621 A1 Sep. 12, 2002

Related U.S. Application Data

(60) Provisional application No. 60/267,777, filed on Feb. 9, 2001, and provisional application No. 60/268,191, filed on Feb. 12, 2001.

(51) Int. Cl.[7] ..... B21D 5/04

(52) U.S. Cl. ..... 72/31.11; 72/319

(58) Field of Search ..... 72/319–321, 316, 72/31.1, 31.11, 31.12

(56) References Cited

U.S. PATENT DOCUMENTS

| | | | | | |
|---|---|---|---|---|---|
| 2,438,319 | A | * | 3/1948 | Kilham | 72/319 |
| 2,494,149 | A | * | 1/1950 | Webb | 72/319 |
| 4,352,282 | A | | 10/1982 | Buske et al. | 72/321 |
| 4,389,869 | A | | 6/1983 | Van Cleave | 72/319 |
| 4,578,980 | A | * | 4/1986 | Beckman | 72/319 |
| 4,671,094 | A | | 6/1987 | Break | 72/319 |
| 4,766,757 | A | * | 8/1988 | Break et al. | 72/319 |
| 4,993,254 | A | | 2/1991 | Mullett, Jr. | 72/319 |
| 5,222,386 | A | | 6/1993 | Jones, Jr. | 72/319 |
| 5,353,620 | A | * | 10/1994 | Olsen et al. | 72/319 |
| 5,375,340 | A | | 12/1994 | Gerritsen | 33/534 |
| 5,743,129 | A | * | 4/1998 | Chubb et al. | 72/319 |
| 6,000,268 | A | | 12/1999 | Van Cleave et al. | 72/211 |
| 6,003,357 | A | | 12/1999 | Brown | 72/321 |
| 6,038,909 | A | | 3/2000 | Zink | 72/319 |
| 6,055,737 | A | | 5/2000 | Sweaney | 33/534 |
| 6,070,696 | A | | 6/2000 | Chubb et al. | 182/227 |
| 6,233,995 | B1 | | 5/2001 | Cleave et al. | 72/211 |

* cited by examiner

*Primary Examiner*—Daniel C. Crane
(74) *Attorney, Agent, or Firm*—Howard & Howard

(57) ABSTRACT

The subject invention provides a sheet bending brake assembly for securing a work piece. The sheet bending brake assembly includes a clamping member having a lower leg extending therefrom and a pivoting arm pivotally supported by and extending from the clamping member. The pivoting arm defines a clamping area with the lower leg. A base supports the clamping members and provides support to the assembly while moving the pivoting arm between the open position and the clamped position. A guide mechanism reacts between the clamping member and the pivoting arm for moving the pivoting arm between the open position and the clamped position. The guide mechanism has a guide slot with a detent positioned within the guide slot between the first and the second ends for positioning the pivoting arm in an intermediate position to allow for precisely aligning the work piece.

61 Claims, 7 Drawing Sheets

SHEET BENDING BRAKE

RELATED APPLICATIONS

This application claims priority to provisional patent applications having Ser. Nos. 60/267,777 and 60/268,191 filed Feb. 9, 2001 and Feb. 12, 2001, respectively.

BACKGROUND OF THE INVENTION

1. Field of the Invention

The subject invention relates to sheet bending brakes.

2. Description of the Related Art

Sheet bending brakes are used for bending and cutting metal or plastic sheets such as those used for siding on homes and buildings. A typical sheet bending brake functions by clamping a work piece between clamping members and using a hinged bending arm to bend the work piece about the clamping member. These sheet bending brakes allow for the clamping member to move between an open position and a clamped position.

In the use of such brakes, the work piece is often forced out of position as the clamping member is moved from the open position to the clamped position. This results from the vibrating and shaking of the bending brake while being moved into the clamped position. Repositioning of the work piece requires that the clamping members be moved back to the open position to release the work piece. After repositioning, the work piece may again be forced out of position as the clamping members are returned to the clamped position. An operator may choose to control the sheet bending brake in an intermediate position by supporting the clamping members with one hand. However, this leaves only one hand free to reposition the work piece and does not allow for precise alignment of the work piece.

Most typical sheet bending brakes used for heavy duty applications are designed to be carried by one person when in a transport position. However, it can be cumbersome and difficult to transport due to its weight. Additionally, sheet bending brakes can be adjusted to varying lengths by adding additional clamping members which makes it more difficult to transport. Therefore, these sheet bending brakes require two people to transport because of an inability for one to lift and move the brake.

The related art sheet bending brakes, as described above, are characterized by one or more inadequacies. Specifically, the sheet bending brakes are limited to only the open position and the clamped position without allowing for precise alignment of the work piece. Additionally, the sheet bending brakes are cumbersome and do not provide for quick and easy transportation of the sheet bending brakes.

SUMMARY OF THE INVENTION AND ADVANTAGES

The subject invention provides a sheet bending brake assembly for securing a work piece. The sheet bending brake assembly includes a clamping member having a lower leg extending therefrom, a pivoting arm pivotally supported by and extending from the clamping member to define a clamping area with the lower leg, and a guide mechanism reacting between the clamping member and the pivoting arm for moving the pivoting arm between an open position and a clamped position. The guide mechanism has a detent between the open and the clamped positions for providing an intermediate clamping position for adjusting the position of and precisely aligning the work piece.

The subject invention further provides the sheet bending brake assembly including a plurality of clamping members and a base supporting the clamping members with the base being collapsible between a transport position and a support position. The base has a front rail and a rear rail defining a table such that the clamping members are supported by the front rail and the rear rail, and the table has a first table end and a second table end. A wheel mechanism is pivotably connected to one of the table ends and is pivotable between a rolling position and a working position for allowing quick and easy transportation of the assembly.

Accordingly, the subject invention overcomes the inadequacies that characterize the related art sheet bending brakes. The subject invention provides the sheet bending brake assembly with the intermediate clamping position that allows for the work piece to be precisely aligned when in the clamped position. Also, the subject invention allows for quick and easy transportation of the sheet bending brake assembly without requiring disassembly or additional assistance.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
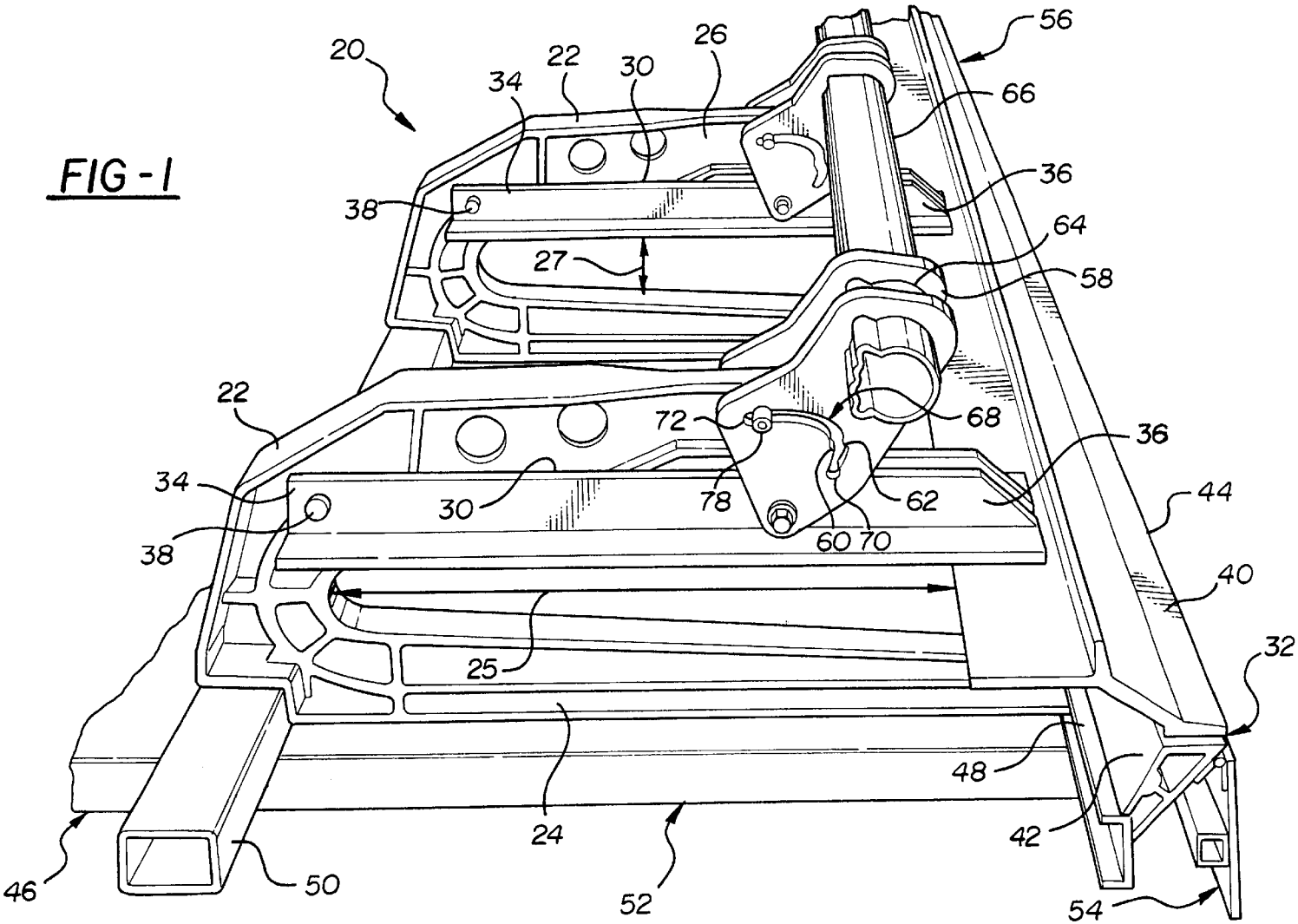
FIG. 1 is a perspective view of a sheet bending brake assembly according to the subject invention.

Referring to the Figures, wherein like numerals indicate like or corresponding parts throughout the several views, a sheet bending brake assembly for securing a work piece 28 is generally shown at 20 in FIG. 1.

Figure 5:
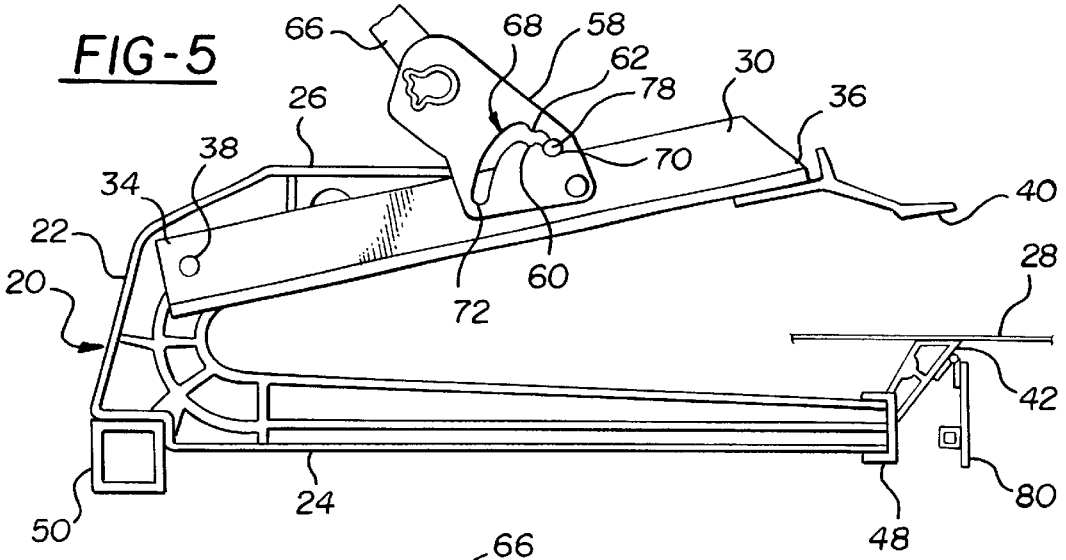
FIG. 5 is a side view of a single clamping member in an open position.
Figure 6:
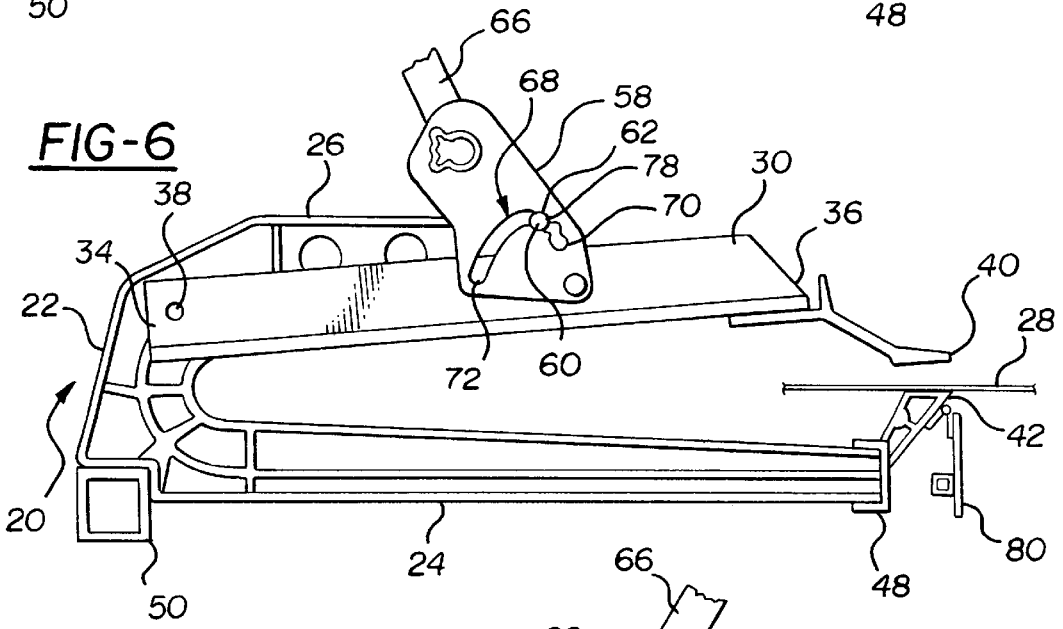
FIG. 6 is a side view of the single clamping member of FIG. 5 in an intermediate position.
Figure 7:
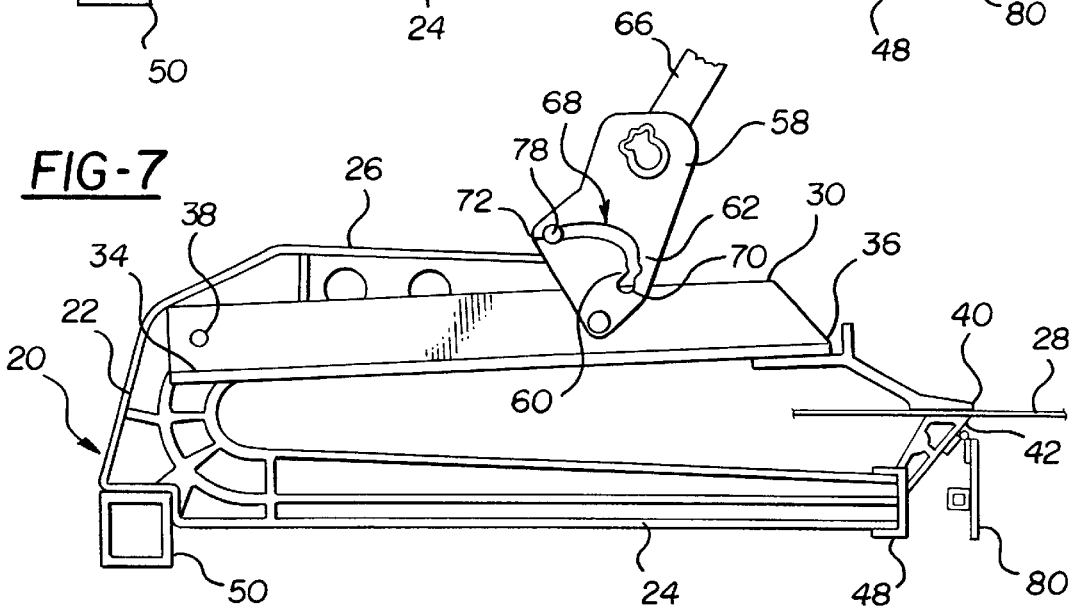
FIG. 7 is a side view of the single clamping member of FIG. 6 in a clamped position.

The sheet bending brake assembly 20 includes a clamping member 22 having a lower leg 24 extending therefrom. The clamping member 22 is generally a C-shaped frame member and has an upper leg 26 extending therefrom. As seen in FIG. 1, a plurality of longitudinally spaced clamping members 22 form the assembly 20 and allow for engaging differently sized work pieces 28, as will be described below. However it is to be understood that any number of clamping members 22 may be utilized with the subject invention. FIGS. 5 through 7 illustrate a single clamping member 22 that forms the sheet bending brake assembly 20. It should be appreciated that each of the frame members is substantially identical. Preferably, the clamping members 22 are made of lightweight aluminum to facilitate transportation of the sheet bending brake assembly 20. However, different materials may be utilized for providing additional support to the assembly 20 as is known in the art of sheet bending brakes.

A pivoting arm 30 is pivotally supported by and extends from the clamping member 22. The pivoting arm 30 defines a clamping area 32 with the lower leg 24. The clamping area 32 has a throat depth 25 and forms a working pocket 27. Designing the C-shaped frame member differently can alter both the throat depth 25 and working pocket 27. The pivoting arm 30 has a secured end 34 and a free end 36, such that a bolt 38 extends through the secured end 34 and into the clamping member 22. The pivoting arm 30 is moveable between an open position and a clamped position by pivoting about the bolt 38 while moving between the open position and the clamped position.

An upper clamping surface 40 is connected to the free end 36 of the pivoting arm 30 and a lower clamping surface 42 is connected to the lower leg 24. The upper clamping surface 40 and the lower clamping surface 42 engage one another in the clamped position to secure the work piece 28 therebetween. The opening between the upper clamping surface 40 and the lower clamping surface 42 is commonly referred to as a mouth opening. After the work piece 28 is secured, the upper and lower clamping surfaces 40, 42 create a bending surface 44 that the work piece 28 is bent about. Additionally, the sheet bending brake assembly 20 may be used with a tool cutter (not shown) for cutting the work piece 28 while in the clamped position. It is to be understood that many different tools known in the art of sheet bending brakes may be utilized with the subject invention.

As shown in FIG. 1, a base 46 supports the clamping members 22 and provides support to the assembly 20 while moving the pivoting arm 30 between the open position and the clamped position. The base 46 includes a front rail 48 and a rear rail 50 defining a table 52 such that the clamping members 22 are supported by the front rail 48 and the rear rail 50. The table 52 has a first table end 54 and a second table end 56.

The assembly 20 further includes a guide mechanism 58 reacting between the clamping member 22 and the pivoting arm 30 for moving the pivoting arm 30 between the open position and the clamped position. The guide mechanism 58 has a detent 60 between the open and the clamped positions for providing an intermediate clamping position for adjusting the position of and precisely aligning the work piece 28. When the sheet bending brake assembly 20 is in the intermediate clamping position, the upper clamping surface 40 is in close proximity to, but not in contact with, the lower clamping surface 42 of the lower leg 24. In order to secure the sheet bending brake assembly 20 in the intermediate position, a stop 62 is positioned adjacent the detent 60 for sustaining the intermediate position.

The guide mechanism 58 has an aperture 64 for receiving a handle 66. The handle 66 extends from the guide mechanism 58 for facilitating movement of the pivoting arm 30 between the open and the clamped positions. The handle 66 functions to move the pivoting arm 30, thereby rotating the guide mechanism 58. The handle 66 may be a single lever for a single clamping member 22, as shown in FIGS. 5 through 8, or a long bar engaging the plurality of clamping members 22 as shown in FIG. 1.

Figure 2:
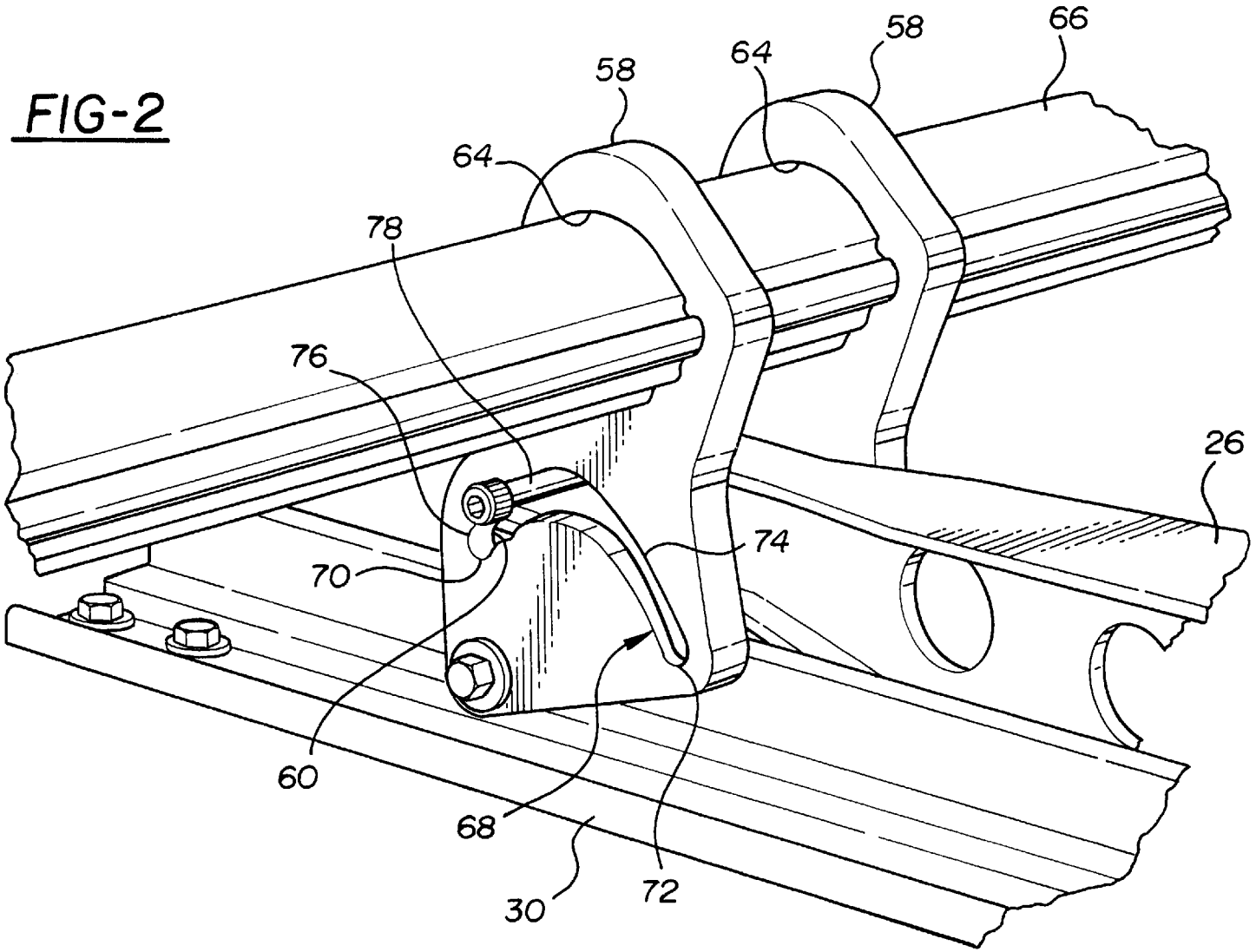
FIG. 2 is a perspective view of a guide mechanism for operating the sheeting bending brake assembly of FIG. 1 from a different angle.
Figure 3:
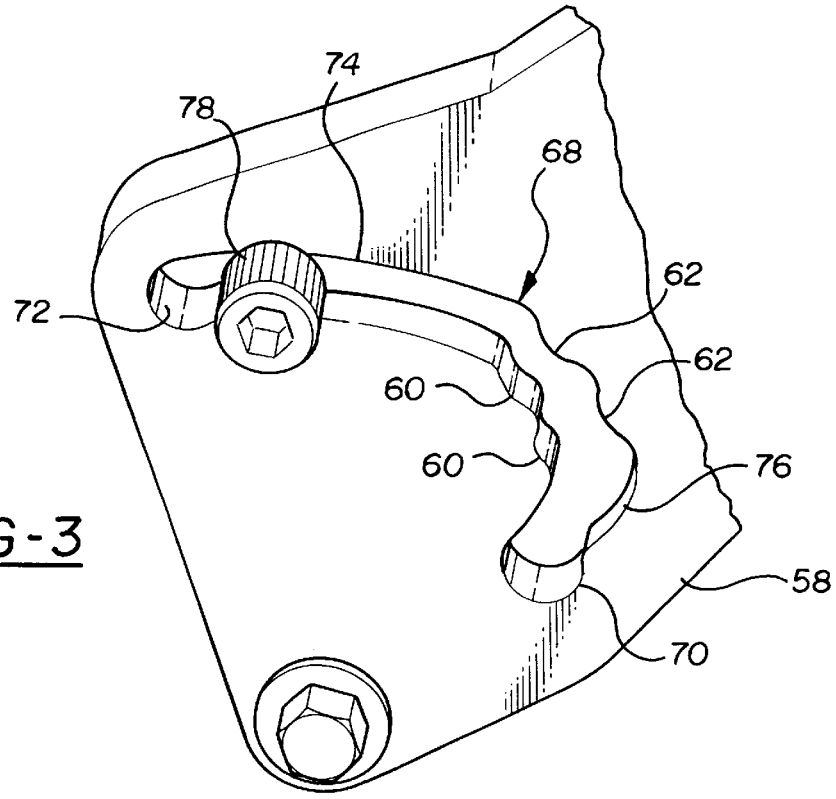
FIG. 3 is a side view of the guide mechanism showing a guide slot receiving a pin.
Figure 4:
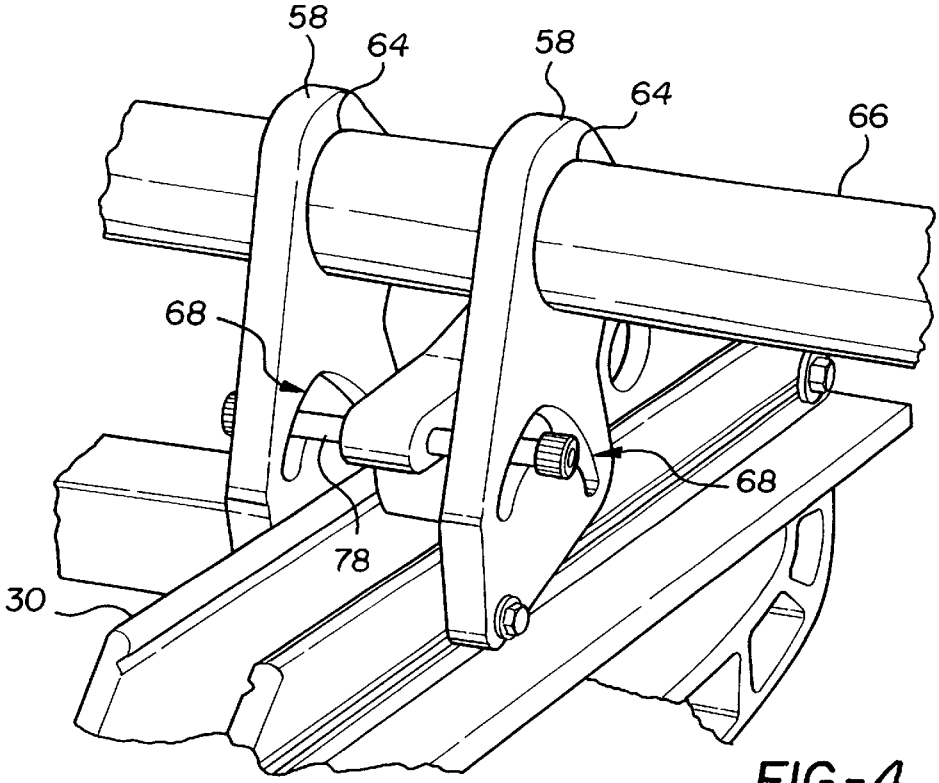
FIG. 4 is yet another perspective view of the guide mechanism.

The guide mechanism 58 also includes a guide slot 68 having a first end 70 and a second end 72 such that the first end 70 corresponds to the open position and the second end 72 corresponds to the clamped position. The detent 60, as shown in FIGS. 2 through 4, is positioned within the guide slot 68 between the first and the second ends 70, 72. In one embodiment, the guide slot 68 is arcuate and includes a long portion 74 and a short portion 76, the long portion 74 being substantially horizontal and the short portion 76 being substantially vertical. The guide slot 68 may be designed differently to accommodate differently sized clamping members 22 without deviating from the subject invention. The guide mechanism 58 may be further defined as a pivot bracket. The pivot bracket has an upper region and a lower region such that the guide slot 68 is disposed between the upper region and the lower region.

In yet another embodiment, referring to FIG. 3, the guide mechanism 58 includes a plurality of detents 60 positioned between the first and the second ends 70, 72. The plurality of detents 60 provides for a plurality of intermediate clamping positions for receiving work pieces 28 of varying thickness. Corresponding to each of the detents 60 is a plurality of stops 62 within the guide slot 68 and adjacent the plurality of detents 60 to secure the sheet bending brake assembly 20 in each of the intermediate positions.

The sheet bending brake assembly 20 has a pin 78 supported by the clamping member 22 and disposed in the guide slot 68 such that the guide mechanism 58 rotates about the pin 78 between the first end 70 and the second end 72. In operation, the handle 66 rotates the guide mechanism 58 about the pin 78, which causes the pivoting arm 30 to move between the open position and the clamped position. Referring to FIG. 5, the single clamping member 22 is shown with the pivoting arm 30 in the open position and with the pin 78 at the first end 70 of the guide slot 68. In FIG. 6, the handle 66 is operated and the pivoting arm 30 is now in the intermediate position and the pin 78 is in the detent 60 of the guide slot 68. The movement into the intermediate position reduces the opening between the upper clamping surface 40 and the lower clamping surface 42 to a predetermined distance. The predetermined distance is determined by the location of the detent 60 within the guide slot 68. As shown, the predetermined distance at the intermediate position is about one inch. Finally, FIG. 7 shows the pivoting arm 30 in the clamped position and in contact with the lower clamping surface 42. In the clamped position, the pin 78 is now in the second end 72 of the guide slot 68.

Figure 8:
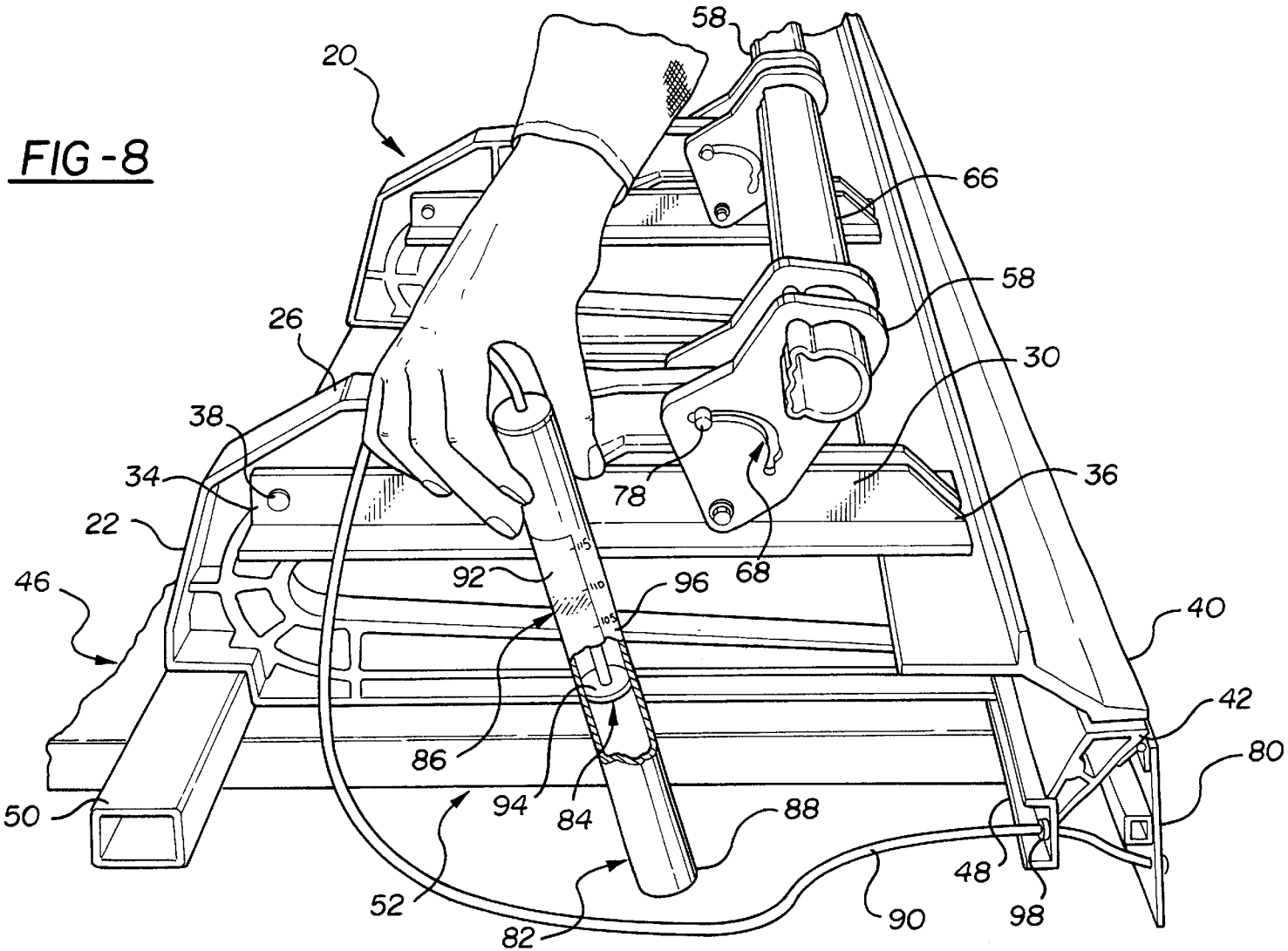
FIG. 8 is a perspective view the sheet bending brake assembly of FIG. 1 having a bend indicator attached.
Figure 9:
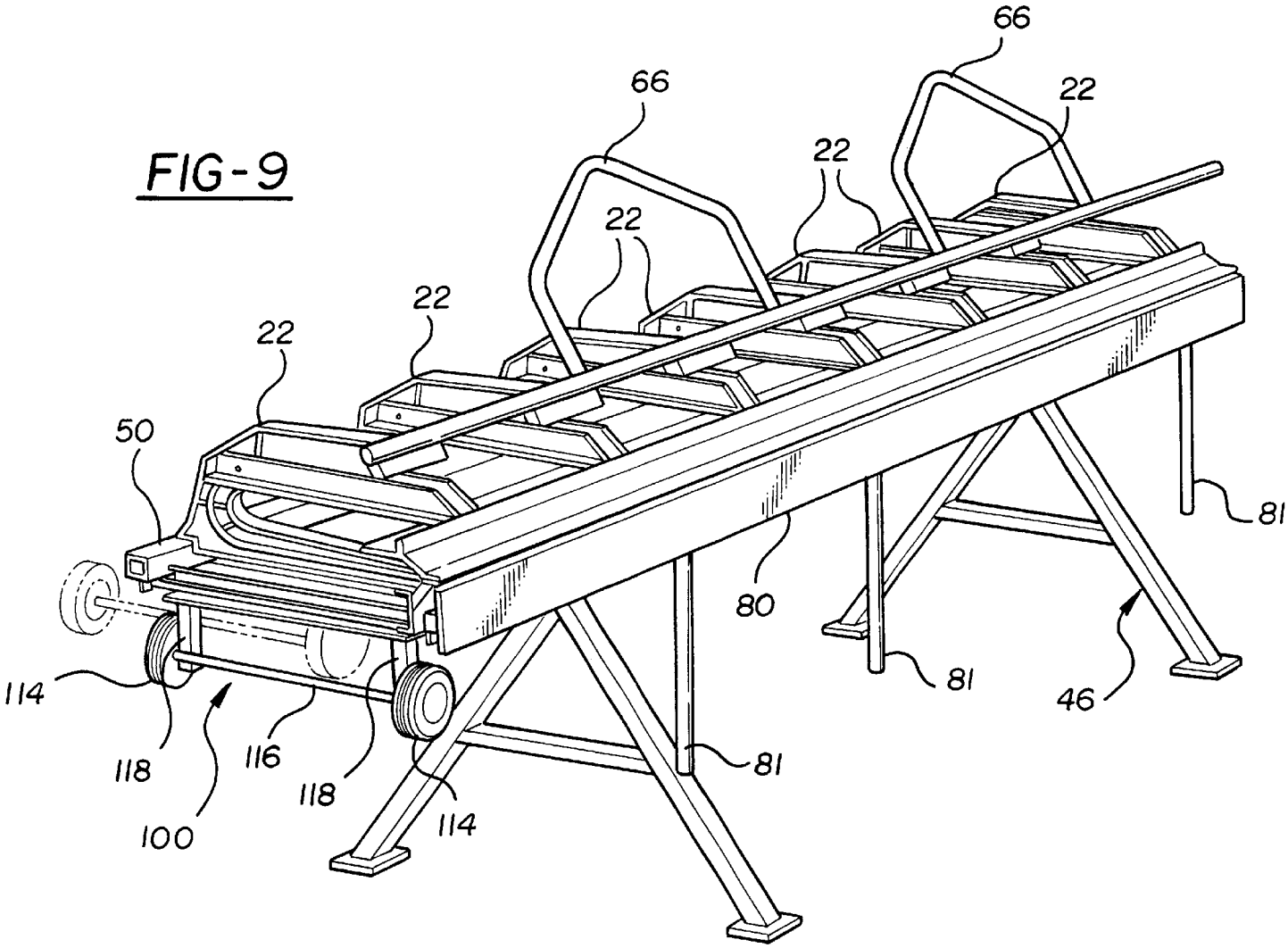
FIG. 9 is a perspective view of a sheet bending brake assembly having a wheel mechanism attached to one end for transporting the assembly.

Referring to FIGS. 8 and 9, a bending arm 80 is supported by the clamping member for engaging the work piece 28 and bending the work piece 28 to a desired angle. The bending arm 80 extends the length of the sheet bending brake assembly 20 and contacts the work piece 28 when rotated. The bending arm 80 is preferably hingedly connected with the lower clamping surface 42. The bending arm 80 also has extensions 81 extending from the bending arm 80 for allowing easy rotation of the bending arm 80.

The assembly 20 further includes a bend indicator 82 connected to the bending arm 80 for indicating a degree of rotation of the bending arm 80 during the bending of the work piece 28. The bend indicator 82 includes a displacement sensor 84 for measuring the degree of rotation of the bending arm 80 and a display device 86 for displaying the degree of rotation of the bending arm 80. The bend indicator 82 may be any type of electrical or mechanical device capable of measuring a degree of rotation. In one embodiment, the displacement sensor 84 is a housing 88 supported by the lower leg 24 and a cable 90 extending from the housing 88 and attaching to the bending arm 80. The cable 90 extends through the lower clamping surface 42 and is fixedly connected to the bending arm 80 such that as the bending arm 80 is moved, the cable 90 is pulled through the lower clamping surface 42. However, it is to be understood that the cable 90 may also extend through the front rail 48 of the base 46. The housing 88 is preferably detached from the table 52, except for the cable 90, to allow for easy viewing of the display device 86 in different positions.

The display device 86 is further defined as a viewing window 92 within the housing 88 and a disc 94 housed within the housing 88 and connected to the cable 90 for moving within the housing 88 to indicate the degree of rotation through the viewing window 92. Indicia 96 may be positioned adjacent the viewing window 92 corresponding to the degree of rotation of the bending arm 80. Further, the bend indicator 82 may include a calibration device 98. The calibration device 98 may be connected to the cable 90 and the bend indicator 82 for calibrating the bend indicator 82. As the assembly 20 is utilized, the cable 90 will stretch and therefore calibrating the bend indicator 82 is required. The calibration device 98 tightens the cable 90 to a desired tautness when the bending arm 80 is a non-bending position. After the cable 90 is tightened, the bend indicator 82 is calibrated for successive uses.

Figure 10:
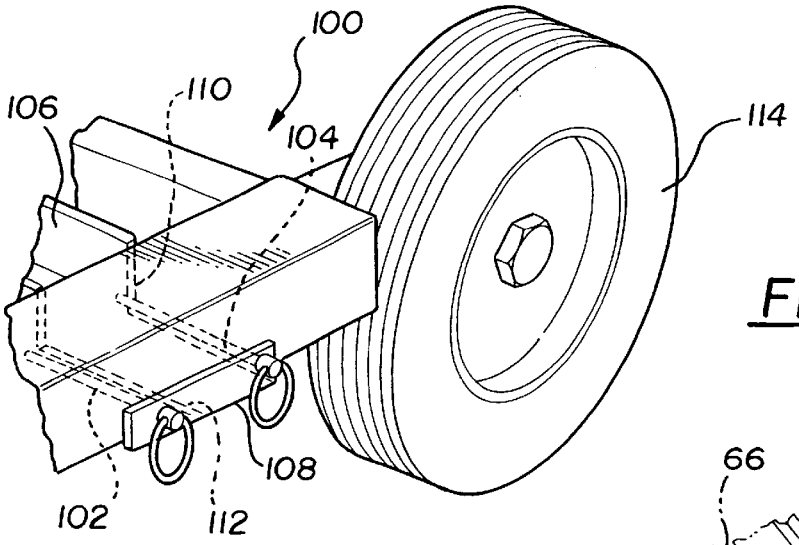
FIG. 10 is a perspective view of the sheet bending brake of FIG. 9 in a rolling position.
Figure 11:
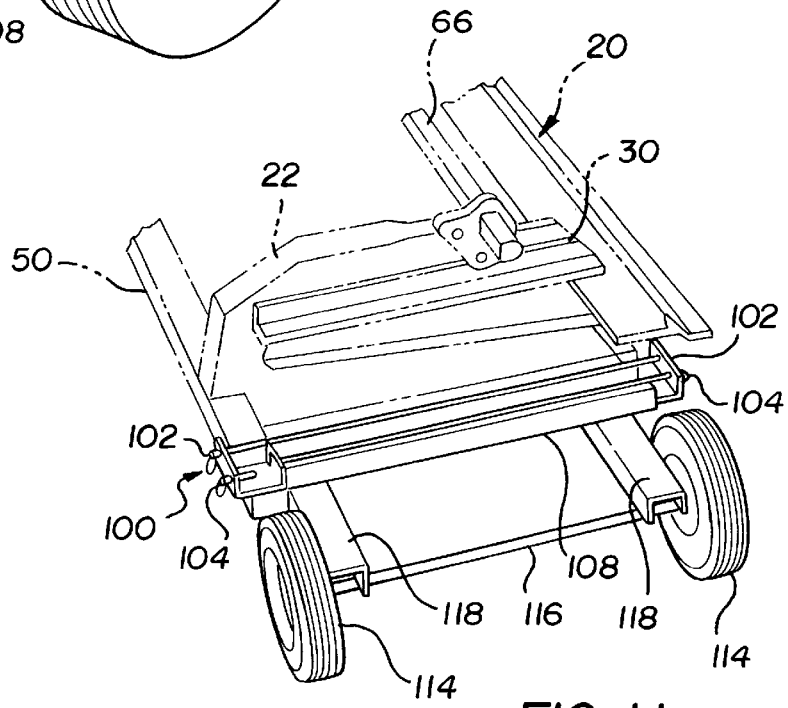
FIG. 11 is a perspective view of the wheel mechanism.
Figure 12:
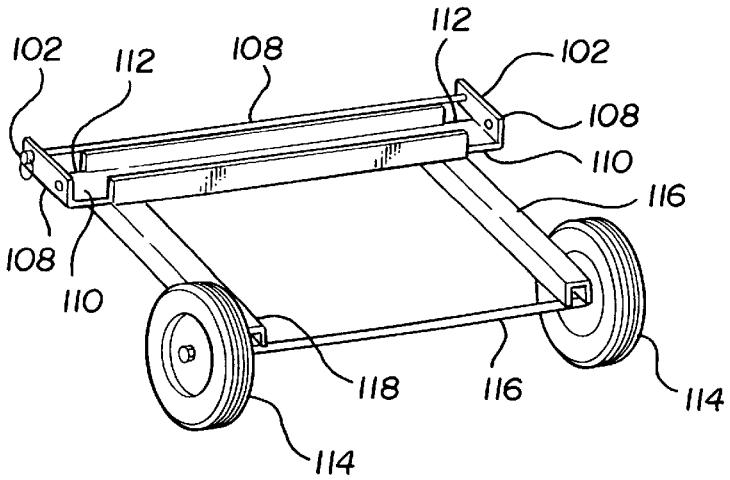
FIG. 12 is another perspective view of the wheel mechanism.

Referring to FIGS. 9 through 12, a wheel mechanism 100 is pivotably connected to one of the table ends 54, 56 and being pivotable 52 between a rolling position and a working position. The wheel mechanism 100 is shown connected to the first table end 54, however, it is to be appreciated that the wheel mechanism 100 may be attached to either the first table end 54 or the second table end 56 or both. The subject invention includes a pivot 102 engaging the wheel mechanism 100 and the table 52 for allowing the wheel mechanism 100 to rotate between the rolling position and the working position. A locking device 104 between the wheel mechanism 100 and the table 52 locks the wheel mechanism 100 in the rolling position and unlocks the wheel mechanism 100 to allow the wheel mechanism 100 to rotate into the working position. The sheet bending brake in FIG. 9 shows the wheel mechanism 100 in the working position. FIGS. 10 through 12 show the wheel mechanism 100 in the rolling position.

The wheel mechanism 100 further includes a wheel brace 106 extending between the front rail 48 and the rear rail 50 and engaging the locking device 104. In one embodiment, the wheel brace 106 is an upwardly facing U-shaped bar. Additionally, the wheel brace 106 has a plate 108 attached to the U-shaped bar. The plate 108 has holes that are aligned with holes in the rails for receiving the locking device 104 and the pivot 102. The locking device 104 and the pivot 102 both engage the plate 108 and the rails 48, 50 to secure the wheel mechanism 100 and to allow the wheel mechanism 100 to pivot. It is to be understood that the wheel brace 106 may be any other shape of material while still accomplishing the subject invention. The wheel brace 106 also has a notch 110 aligned with the front rail 48 and the rear rail 50. The notch 110 receives the front rail 48 and the rear rail 50 in the rolling position. The notch 110 has an indentation 112 that allows the wheel mechanism 100 to pivot 102 without contacting either of the front or rear rails 48, 50. The indentation 112 receives the front rail 48 and the rear rail 50 when in the working position.

The wheel mechanism 100 also includes a pair of wheels 114 having a wheel support 116 extending therebetween and being connected to the wheel brace 106. The wheels are used for transporting the assembly 20. The pair of wheels 114 may be replaced with any other device, such as a roller, as is known in the art. A wheel extension 118 interconnects the wheel support 116 and the wheel brace 106 such that as the wheel extension 118 pivots, the wheel mechanism 100 extends a predetermined amount below the table 52 to allow for insertion of the work piece 28 within the clamping area 32, as shown in FIG. 9. In one embodiment, the front and rear rails 48, 50 do not extend beyond the wheel mechanism 100 any further than the radius of each wheel to prevent the front and rear rails 48, 50 from contacting the ground during transport. After the base 46 has been collapsed into the transport position, the wheel mechanism 100 presently described can be used by one person to transport the sheet bending brake assembly 20.

To secure the sheet bending brake to the table 52, the wheel mechanism 100 is pivoted such that the rails are seated in the notch 110. Then, the locking device 104 is inserted through the hole in the plate 108 in the front and rear rails 48, 50. As illustrated, the locking device 104 is a locking pin having a ring for easy removal. The locking pin is the pin closest to the pair of wheels 114. After transport, the sheet bending brake may be lifted to rest upon the base 46 for use as shown in FIG. 9. Removal of the locking pin from the front rail 48 and the rear rail 50 allows the wheel assembly 20 to rotate about the pivot 102. The pivot 102 is preferably a pivot pin having a ring and extending through the plate 108 and the front rail 48 and rear rail 50. However, it is to be understood that the pivot 102 may also be a rod extending the width of the table 52 and engaging the plate 108 on the opposite side. In the preferred embodiment, the pivot pin is farthest away from the pair of wheels 114. As described above, the indentation 112 in the notch 110 is aligned with the center of the pivot pin. The indention is aligned with the center of the pivot 102 to allow the front and rear rails 48, 50 to be received by the notch 110 when the locking pin is removed. It is to be understood that the indention may be aligned differently by modifying other features of the wheel mechanism 100.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A sheet bending brake assembly for securing a work piece, said sheet bending brake assembly comprising:

a clamping member having a lower leg extending therefrom;

a pivoting arm pivotally supported by and extending from said clamping member to define a clamping area with said lower leg;

a guide mechanism reacting between said clamping member and said pivoting arm for moving said pivoting arm between an open position and a clamped position;

said guide mechanism having a detent between said open and said clamped positions for providing an intermediate clamping position for adjusting the position of and precisely aligning the work piece.

2. An assembly as set forth in claim 1 wherein said guide mechanism further includes a guide slot having a first end and a second and such that said first end corresponds to said open position and said second end corresponds to said clamped position.

3. An assembly as set forth in claim 2 wherein said detent is positioned within said guide slot between said first and said second ends.

4. As assembly as set forth in claim 3 further including a stop within said guide slot and adjacent said detent for sustaining said intermediate position.

5. An assembly as set forth in claim 4 wherein said guide slot is arcuate.

6. An assembly as set forth in claim 5 wherein said guide slot further includes a long portion and a short portion, said long portion being substantially horizontal and said short portion being substantially vertical.

7. An assembly as set forth in claim 6 wherein said guide mechanism is further defined as a pivot bracket, said pivot bracket having and upper region and a lower region such that said guide slot is disposed between said upper region and said lower region.

8. An assembly as set forth in claim 4 further including a pin supported by said clamping member and disposed in said guide slot such; that said guide mechanism rotates about said pin between said first end and said second end.

9. An assembly as set forth in claim 2 wherein said guide mechanism further includes a plurality of detents positioned between said first and said second ends for providing a plurality of intermediate clamping positions for receiving work pieces of varying thickness.

10. An assembly as set forth in claim 9 further including a plurality of stops within said guide slot and adjacent said plurality of detents.

11. An assembly as set forth in claim 4 further including a plurality of clamping members connected to said assembly for engaging differently sized work pieces.

12. An assembly as set forth in claim II further including a base supporting said clamping members to provide support to said assembly while moving said pivoting arm between said open and said closed positions.

13. An assembly as set forth in claim 12 further including a handle extending from said guide mechanism for facilitating movement of said pivoting arm between said open and said closed positions.

14. An assembly as set forth in claim 1 further including a bending arm supported by said clamping member for engaging the work piece and bending the work piece to a desired angle.

15. An assembly as set forth in claim 1 further including a bend indicator connected to said bending arm for indicating a degree of rotation of said bending arm during said bending of the work piece.

16. An assembly as set forth in claim 15 further including a lower clamping surface connected to said lower leg and an upper clamping surface connected to said pivoting arm for securing the work piece between said lower and upper surfaces and creating a bending surface for bending the work piece in said clamped position.

17. An assembly as set forth in claim 16 wherein said bend indicator further includes a displacement sensor for measuring said degree of rotation of said bending arm.

18. An assembly as set forth in claim 17 wherein said bend indicator further includes a display device for displaying said degree of rotation of said bending arm.

19. An assembly as set forth in claim 18 wherein said displacement sensor is further defined as a housing supported by said lower leg and a cable extending from said housing and attaching to said bending arm.

20. An assembly as set forth in claim 19 wherein said display device is further defined as a viewing window within said housing and a disc housed within said housing and connected to said cable for moving within said housing to indicate said degree of rotation through said viewing window.

21. An assembly as set forth in claim 20 further including indicia positioned adjacent said viewing window corresponding to said degree of rotation.

22. An assembly as set forth in claim 18 further including a calibration device connected to said cable and said bend indicator for calibrating said bend indicator.

23. An assembly as set forth in claim 1 further including a plurality of clamping members connected to said assembly for engaging work pieces of varying length.

24. An assembly as set forth in claim 23 further including a base supporting said clamping members with said base being collapsible between a transport position and a support position.

25. An assembly as set forth in claim 24 wherein said base further includes a front rail and a rear rail defining a table such that said clamping members are supported by said front rail and said rear rail.

26. An assembly as set forth in claim 25 wherein said table is further defined as having a first table end and a second table end.

27. An assembly as set forth in claim 26 further including a wheel mechanism pivotably connected to one of said table ends and being pivotable between a rolling position and a working position.

28. An assembly as set forth in claim 27 further including a pivot engaging said wheel mechanism and said table for allowing said wheel mechanism to rotate between said rolling position and said working position.

29. An assembly as set forth in claim 28 further including a locking device between said wheel mechanism and said table for locking said wheel mechanism in said rolling position and unlocking said wheel mechanism to alloy said wheel mechanism to rotate into said working position.

30. An assembly as set forth in claim 29 wherein said wheel mechanism further includes a wheel brace extending between said front rail and said rear rail and engaging said locking device.

31. An assembly as set forth in claim 30 wherein said wheel mechanism further includes a pair of wheels having a wheel support extending between said wheels and being connected to said wheel brace for transporting said assembly.

32. An assembly as set forth in claim 31 further including a wheel extension connecting said wheel support to said wheel brace such that as said wheel extension pivots, said wheel mechanism extends a predetermined amount below said table to allow for insertion of the work piece within said clamping area.

33. A sheet bending brake assembly for securing a work piece, said sheet bending brake assembly comprising:

a plurality of clamping members;

a base supporting said clamping members with said base being collapsible between a transport position and a support position;

said base having a front rail and a rear rail defining a table such that said clamping members are supported by said front rail and said rear rail;

said table having a first table end and a second table end; and a wheel mechanism pivotably connected to one of paid table ends and being pivotable between a rolling position and a working position for allowing quick and easy transportation of said assembly.

34. An assembly as set forth in claim 33 further including a pivot engaging said wheel mechanism and said table for allowing said wheel mechanism to rotate between said rolling position and said working position.

35. An assembly as set forth in claim 34 further including a locking device between said wheel mechanism and said table for locking said wheel mechanism in said rolling position and unlocking said wheel mechanism to allow said wheel mechanism to rotate into said working position.

36. An assembly as set forth in claim 35 wherein said wheel mechanism further includes a wheel brace extending between said front rail and said rear rail and engaging said locking device.

37. An assembly as set forth in claim 36 wherein said wheel brace has slots for receiving said front rail and said rear rail, each of said slots being U-shaped to allow said locking device to extend therethrough and to secure said wheel mechanism to said front and rear rails.

38. An assembly as set forth in claim 36 wherein said wheel mechanism further includes a pair of wheels having a wheel support extending between said wheels and being connected to said wheel brace for transporting said assembly.

39. An assembly as set forth in claim 38 further including a wheel extension connecting said wheel support to said wheel brace such that as said wheel extension pivots, said wheel mechanism extends a predetermined amount below said table to allow for insertion of the work piece within said clamping area.

40. An assembly as set forth in claim 34 wherein said pivot is further defined as a pin engaging said wheel mechanism and said table.

41. An assembly as set forth in claim 35 wherein said locking device is further defined as a locking pin between said wheel mechanism and said table.

42. An assembly as set forth in claim 33 wherein each of said clamping members have a lower leg extending therefrom and a pivoting arm pivotally supported by and extending from said clamping member to define a clamping area with said lower leg.

43. An assembly as set forth in claim 42 further including a guide mechanism reacting between said clamping member and said pivoting arm for moving said pivoting arm between an open position and a closed position.

44. An assembly as set forth in claim 43 wherein said guide mechanism further includes a detent between said open and said clamped positions for providing an intermediate clamping position for adjusting the position of and precisely aligning the work piece.

45. An assembly as set forth in claim 44 wherein said guide mechanism further includes a guide slot having a first end and a second end such that said first end corresponds to said open position and said second end corresponds to said clamped position.

46. An assembly as set forth in claim 45 wherein said detent is positioned within said guide slot between said first and said second ends.

47. As assembly as set forth in claim 46 further including a stop within said guide slot and adjacent said detent for sustaining said intermediate position.

48. An assembly as set forth in claim 47 wherein said guide mechanism is further defined as a pivot bracket, said pivot bracket having an upper region and a lower region such that said guide slot is disposed between said upper region and said lower region.

49. An assembly as set forth in claim 48 further including a pin supported by said clamping member and disposed in said guide slot such that said guide mechanism rotates about said pin between said first end and said second end.

50. A sheet bending brake assembly for securing a work piece, said sheet bending brake assembly comprising:

a clamping member having a lower leg extending therefrom;

a pivoting arm pivotally supported by and extending from said clamping member to define a clamping area with said lower leg;

a lower clamping surface connected to said lower 14*g* and an upper clamping surface connected to said pivoting arm for securing the work piece between said lower and upper surfaces and creating a bending surface for bending the work piece in said clamped position;

a bending arm supported by said clamping member for engaging the work piece and bending the work piece to a desired angle; and a bend indicator including a housing and a cable extending from said housing and said cable attaching to said bending arm degree of rotation of said bending arm during said bending of the work piece.

51. An assembly as set forth in claim 50 wherein said bend indicator further includes a display device for displaying said degree of rotation of said bending arm.

52. An assembly as set forth in claim 51 wherein said display device is further defined as a viewing window within said housing and a disc housed within said housing and connected to said cable for moving within said housing to indicate said degree of rotation through said viewing window.

53. An assembly as set forth in claim 52 further including indicia positioned adjacent said viewing window corresponding to said degree of rotation.

54. An assembly as set forth in claim 53 further including a calibration device connected to said cable and said bend indicator for calibrating said bend indicator.

55. An assembly as set forth in claim 54 further including a guide mechanism reacting between said clamping member and said pivoting arm for moving said pivoting arm between an open position and a closed position.

56. An assembly as set forth in claim 55 wherein said guide mechanism includes a detent between said open and said clamped positions for providing an intermediate clamping position for adjusting the position of and precisely aligning the work piece.

57. An assembly as set forth in claim 56 wherein said guide mechanism further includes a guide slot having a first end and a second end such that said first end corresponds to said open position and said second end corresponds to said clamped position.

58. An assembly as set forth in claim 57 wherein said detent is positioned within said guide slot between said first and said second ends.

59. As assembly as set forth in claim 58 further including a stop within said guide slot and adjacent said detent for sustaining said intermediate position.

60. An assembly as set forth in claim 59 wherein said guide mechanism is further defined as a pivot bracket, said pivot bracket having an upper region and a lower region such that said guide slot is disposed between said upper region and said lower region.

61. An assembly as set forth in claim 60 further including a pin supported by said clamping member and disposed in said guide slot such that said guide mechanism rotates about said pin between said first end and said second end.

* * * * *

UNITED STATES PATENT AND TRADEMARK OFFICE

CERTIFICATE OF CORRECTION

PATENT NO. : 6,675,619 B2
DATED : January 13, 2004
INVENTOR(S) : Michael C. Clark It is certified that error appears in the above-identified patent and that said Letters Patent is hereby corrected as shown below:

Column 7,
Line 4, delete “As” and insert therefore -- An --.
Line 20, delete semi-colon “;”.
Line 45, delete “1” and insert therefore -- 14 --.

Column 8,
Line 35, delete “alloy” and insert therefore -- allow --.
Line 63, delete “paid” and insert therefore -- said --.

Column 9,
Line 58, delete “As” and insert therefore -- An --.

Column 10,
Line 10, delete “14g” and insert therefore -- 14 --.
Line 20, after “arm” insert therefore -- for indicating a --.
Line 24, after “arm.” insert therefore -- during said bending of the work piece. --.
Line 54, delete “As” and insert therefore -- An --.

Signed and Sealed this

Twentieth Day of April, 2004

JON W. DUDAS
*Acting Director of the United States Patent and Trademark Office*